US009577305B2

(12) United States Patent
Harwath

(10) Patent No.: US 9,577,305 B2
(45) **Date of Patent: *Feb. 21, 2017**

(54) LOW ATTENUATION STRIPLINE RF TRANSMISSION CABLE

(75) Inventor: Frank A Harwath, Naperville, IL (US)

(73) Assignee: CommScope Technologies LLC, Hickory, NC (US)

( * ) Notice: Subject to any disclaimer, the term of this patent is extended or adjusted under 35 U.S.C. 154(b) by 779 days.

This patent is subject to a terminal disclaimer.

(21) Appl. No.: 13/427,313

(22) Filed: Mar. 22, 2012

(65) Prior Publication Data

US 2013/0037300 A1 Feb. 14, 2013

Related U.S. Application Data

(63) Continuation-in-part of application No. 13/208,443, filed on Aug. 12, 2011, now abandoned.

(51) Int. Cl.
*H01B 7/08* (2006.01)
*H01P 3/06* (2006.01)

(52) U.S. Cl.
CPC ..... *H01P 3/06* (2013.01); *Y10T 29/49123* (2015.01)

(58) Field of Classification Search
CPC ..... H01B 7/08
USPC ..... 174/115, 117 F, 117 FF, 119 R
See application file for complete search history.

(56) References Cited

U.S. PATENT DOCUMENTS 479,525 A 7/1892 Perrine
2,060,913 A 11/1936 Weaver
2,200,776 A 5/1940 Hoover
2,267,455 A 12/1941 Gerhard
2,847,499 A 8/1958 Peterson
2,994,050 A 7/1961 Ayer et al.
3,258,724 A 6/1966 Walsh et al.
3,586,757 A 6/1971 Haldeman et al.
3,671,662 A * 6/1972 Miller ..... H01B 11/1834 174/117 F
3,757,029 A 9/1973 Marshall
4,382,236 A 5/1983 Suzuki
4,441,088 A 4/1984 Anderson
4,490,690 A 12/1984 Suzuki
4,816,618 A * 3/1989 Bongianni ..... 174/102 R
5,003,126 A * 3/1991 Fujii et al. ..... 174/36
5,021,007 A 6/1991 Viaud
5,065,122 A 11/1991 Juskey et al.
(Continued)

FOREIGN PATENT DOCUMENTS

JP 2001-085805 3/2001
JP 2001-313444 11/2001
JP 2004-152963 5/2004

*Primary Examiner* — Chau N Nguyen
(74) *Attorney, Agent, or Firm* — Myers Bigel P.A.

(57) ABSTRACT

A stripline RF transmission cable has a flat inner conductor surrounded by a dielectric layer that is surrounded by an outer conductor. The outer conductor has a top section and a bottom section which transition to a pair of edge sections that interconnect the top section with the bottom section. The top section, bottom section and the inner conductor may be provided with generally equal widths. An average dielectric constant of the dielectric layer may be lower between the inner conductor edges and the edge sections than between a mid section of the inner conductor and the top and the bottom sections and/or spacing between the inner conductor and the dielectric layer may be reduced proximate a mid section of the inner conductor.

5 Claims, 12 Drawing Sheets

(56) References Cited

U.S. PATENT DOCUMENTS

| | | | | |
|---|---|---|---|---|
| 5,068,632 | A | 11/1991 | Champeau | |
| 5,393,933 | A | 2/1995 | Goertz | |
| 5,569,876 | A * | 10/1996 | Podgorski | 174/28 |
| 5,713,415 | A | 2/1998 | Bridges | |
| 5,834,700 | A * | 11/1998 | Panella | 174/115 |
| 5,847,324 | A | 12/1998 | Farquhar et al. | |
| 5,900,589 | A | 5/1999 | Brunt | |
| 6,005,193 | A | 12/1999 | Markel | |
| 6,055,722 | A | 5/2000 | Tighe et al. | |
| 6,225,563 | B1 | 5/2001 | Poulsen | |
| 6,422,893 | B1 | 7/2002 | Caldwell | |
| 6,501,350 | B2 | 12/2002 | Lester | |
| 6,545,223 | B2 | 4/2003 | Baldock | |
| 6,608,256 | B2 | 8/2003 | Suzuki et al. | |
| 6,653,570 | B1 | 11/2003 | Elrod | |
| 7,034,229 | B2 | 4/2006 | Victor | |
| 7,170,008 | B2 | 1/2007 | Victor | |
| 7,173,190 | B2 | 2/2007 | Bothe et al. | |
| 7,220,332 | B2 | 5/2007 | Curro et al. | |
| 7,304,246 | B2 | 12/2007 | Huffman | |
| 7,388,155 | B2 | 6/2008 | Forbes | |
| 7,482,535 | B2 | 1/2009 | Sexton et al. | |
| 7,482,540 | B2 | 1/2009 | Shukushima et al. | |
| 7,737,358 | B2 | 6/2010 | Hopkinson et al. | |
| 7,737,359 | B2 | 6/2010 | Sexton et al. | |
| 7,902,456 | B2 | 3/2011 | Witthoft et al. | |
| 2009/0035600 | A1 * | 2/2009 | Chiang | 428/623 |
| 2010/0294531 | A1 * | 11/2010 | Wefers | H01B 7/0861 174/102 R |
| 2011/0088944 | A1 * | 4/2011 | Ogue | B60R 16/0215 174/72 A |
| 2012/0043117 | A1 | 2/2012 | Kato et al. | |

* cited by examiner

LOW ATTENUATION STRIPLINE RF TRANSMISSION CABLE

CROSS REFERENCE TO RELATED APPLICATIONS

This application is a continuation-in-part of commonly owned co-pending U.S. Utility patent application Ser. No. 13/208,443, titled "Stripline RF Transmission Cable" filed 12 Aug. 2011 by Frank A. Harwath, hereby incorporated by reference in its entirety.

BACKGROUND

Field of the Invention

RF Transmission systems are used to transmit RF signals from point to point, for example from an antenna to a transceiver or the like. Common forms of RF transmission systems include coaxial cables and striplines.

Description of Related Art

Prior coaxial cables typically have a coaxial configuration with a circular outer conductor evenly spaced away from a circular inner conductor by a dielectric support such as polyethylene foam or the like. The electrical properties of the dielectric support and spacing between the inner and outer conductor define a characteristic impedance of the coaxial cable. Circumferential uniformity of the spacing between the inner and outer conductor prevents introduction of impedance discontinuities into the coaxial cable that would otherwise degrade electrical performance.

An industry standard characteristic impedance is 50 ohms. Coaxial cables configured for 50 ohm characteristic impedance generally have an increased inner conductor diameter compared to higher characteristic impedance coaxial cables such that the metal inner conductor material cost is a significant portion of the entire cost of the resulting coaxial cable. To minimize material costs, the inner and outer conductors may be configured as thin metal layers for which structural support is then provided by less expensive materials. For example, commonly owned U.S. Pat. No. 6,800,809, titled "Coaxial Cable and Method of Making Same", by Moe et al, issued Oct. 5, 2004, hereby incorporated by reference in the entirety, discloses a coaxial cable structure wherein the inner conductor is formed by applying a metallic strip around a cylindrical filler and support structure comprising a cylindrical plastic rod support structure with a foamed dielectric layer there around. The resulting inner conductor structure has significant materials cost and weight savings compared to coaxial cables utilizing solid metal inner conductors. However, these structures incur additional manufacturing costs, due to the multiple additional manufacturing steps required to sequentially apply each layer of the structure.

One limitation with respect to metal conductors and/or structural supports replacing solid metal conductors is bend radius. Generally, a larger diameter coaxial cable will have a reduced bend radius before the coaxial cable is distorted and/or buckled by bending. In particular, structures may buckle and/or be displaced out of coaxial alignment by cable bending in excess of the allowed bend radius, resulting in cable collapse and/or degraded electrical performance.

A stripline is a flat conductor sandwiched between parallel interconnected ground planes. Striplines have the advantage of being non-dispersive and may be utilized for transmitting high frequency RF signals. Striplines may be cost effectively generated using printed circuit board technology or the like. However, striplines may be expensive to manufacture in longer lengths/larger dimensions. Further, where a solid stacked printed circuit board type stripline structure is not utilized, the conductor sandwich is generally not self supporting and/or aligning, compared to a coaxial cable, and as such may require significant additional support/reinforcing structure.

Competition within the RF transmission line industry has focused attention upon reducing materials and manufacturing costs, electrical characteristic uniformity, defect reduction and overall improved manufacturing quality control.

Therefore, it is an object of the invention to provide a coaxial cable and method of manufacture that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventor has recognized that the prior accepted coaxial cable design paradigm of concentric circular cross section design geometries results in unnecessarily large coaxial cables with reduced bend radius, excess metal material costs and/or significant additional manufacturing process requirements.

Figure 1:
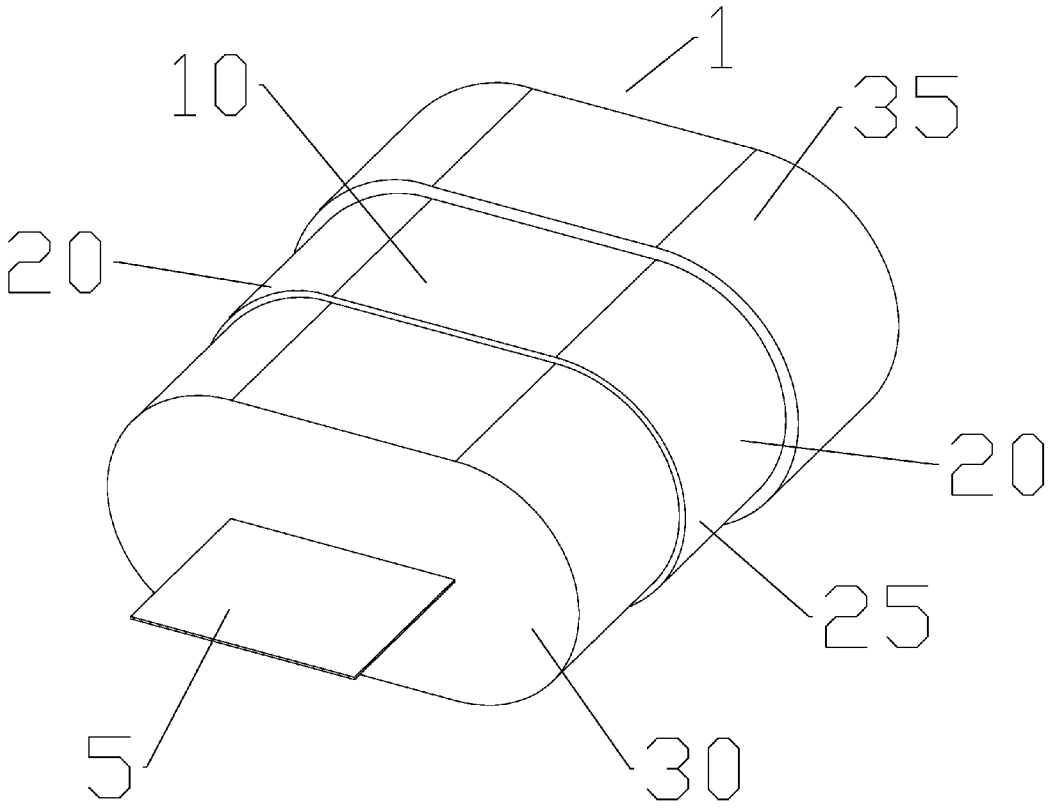
FIG. 1 is a schematic isometric view of an exemplary transmission line, with layers of the conductors, dielectric spacer and outer jacket stripped back.
Figure 2:
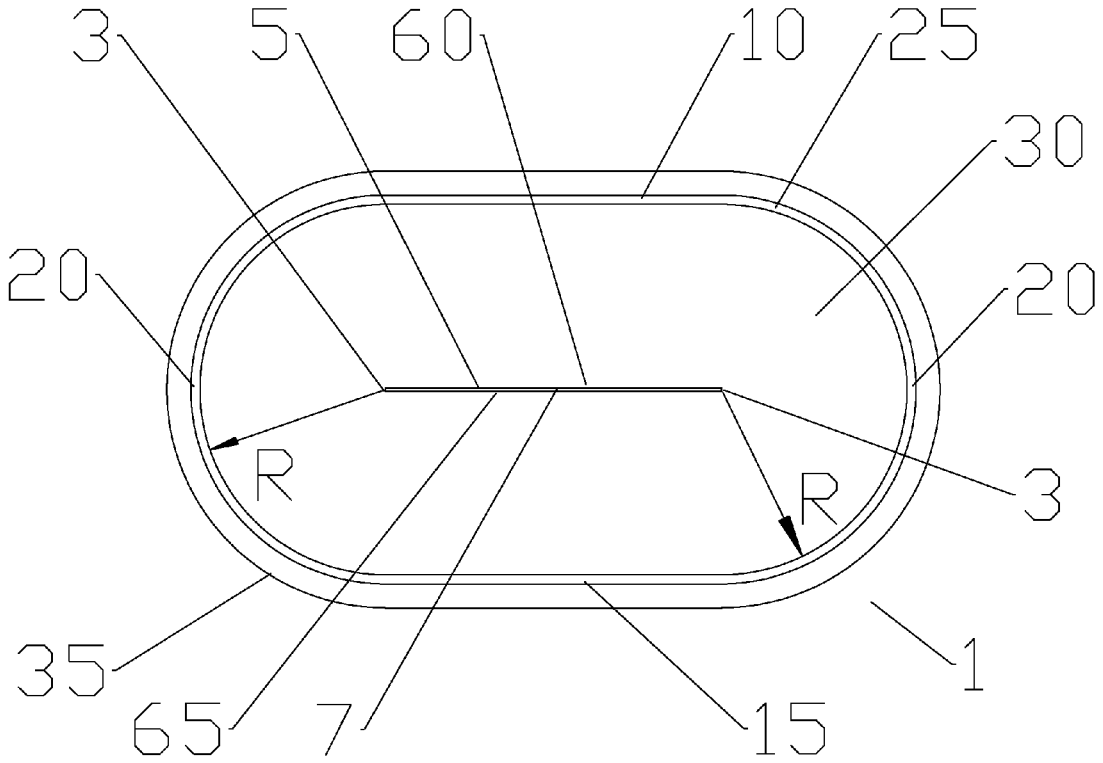
FIG. 2 is a schematic end view of the transmission line of FIG. 1.
Figure 3:
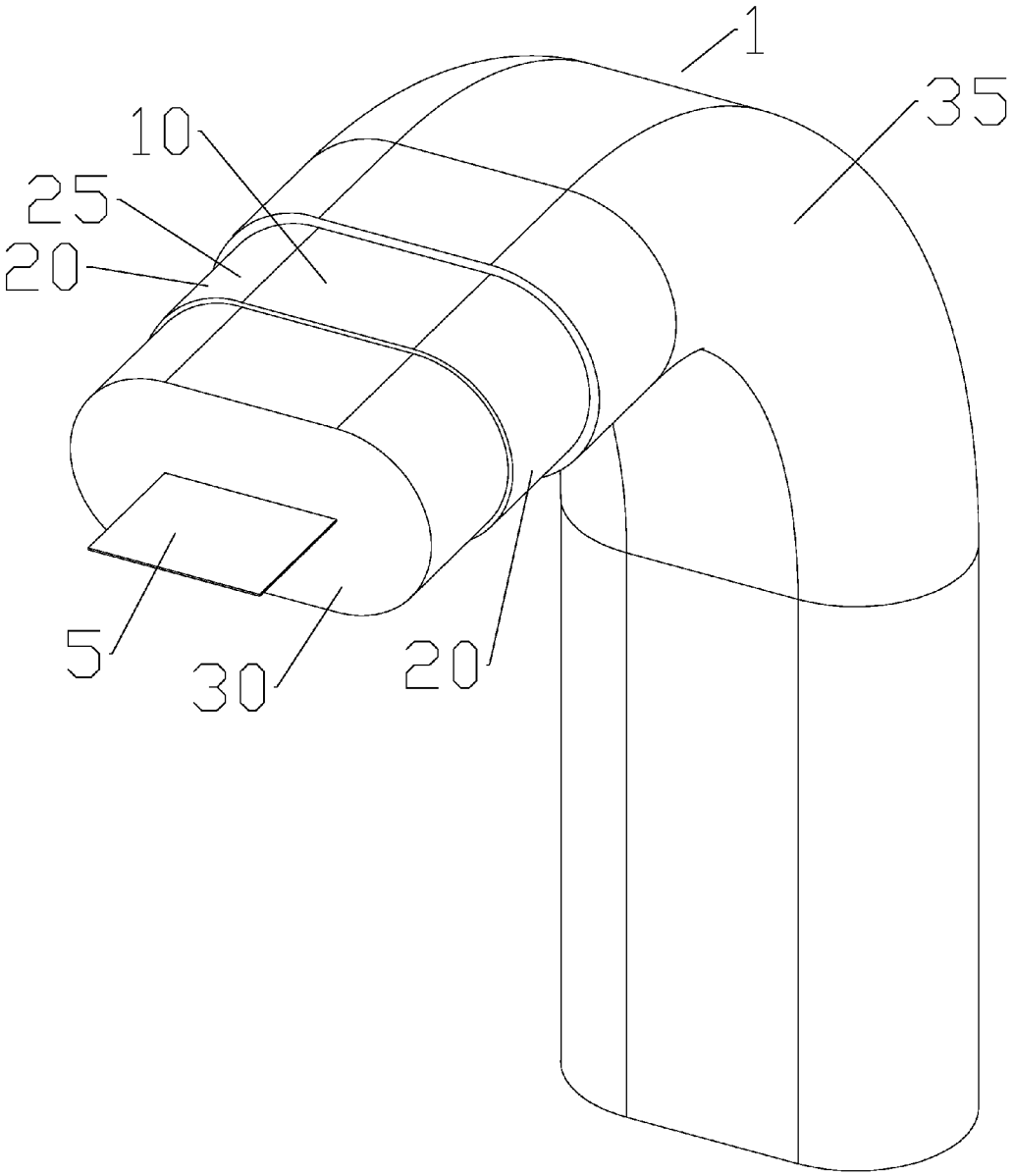
FIG. 3 is a schematic isometric view demonstrating a bend radius of the transmission line of FIG. 1.

An exemplary stripline RF transmission cable 1 is demonstrated in FIGS. 1-3. As best shown in FIG. 1, the inner conductor 5 of the cable 1, extending between a pair of inner conductor edges 3, is a flat metallic strip. A top section 10 and a bottom section 15 of the outer conductor 25 are aligned parallel to the inner conductor 5 with widths equal to the inner conductor width. The top and bottom sections 10, 15 transition at each side into convex edge sections 20. Thus, the circumference of the inner conductor 5 is entirely sealed within an outer conductor 25 comprising the top section 10, bottom section 15 and edge sections 20.

The dimensions/curvature of the edge sections 20 may be selected, for example, for ease of manufacture. Preferably, the edge sections 20 and any transition thereto from the top and bottom sections 10, 15 is generally smooth, without sharp angles or edges. As best shown in FIG. 2, the edge sections 20 may be provided as circular arcs with an arc radius R, with respect to each side of the inner conductor 5, equivalent to the spacing between each of the top and bottom sections 10, 15 and the inner conductor 5, resulting in a generally equal spacing between any point on the circumference of the inner conductor 5 and the nearest point of the outer conductor 25, minimizing outer conductor material requirements.

The desired spacing between the inner conductor 5 and the outer conductor 25 may be obtained with high levels of precision via application of a uniformly dimensioned spacer structure with dielectric properties, referred to as the dielectric layer 30, and then surrounding the dielectric layer 30 with the outer conductor 25. Thereby, the cable 1 may be provided in essentially unlimited continuous lengths with a uniform cross section at any point along the cable 1.

The inner conductor 5 metallic strip may be formed as solid rolled metal material such as copper, aluminum, steel or the like. For additional strength and/or cost efficiency, the inner conductor 5 may be provided as copper coated aluminum or copper coated steel.

Figure 4:
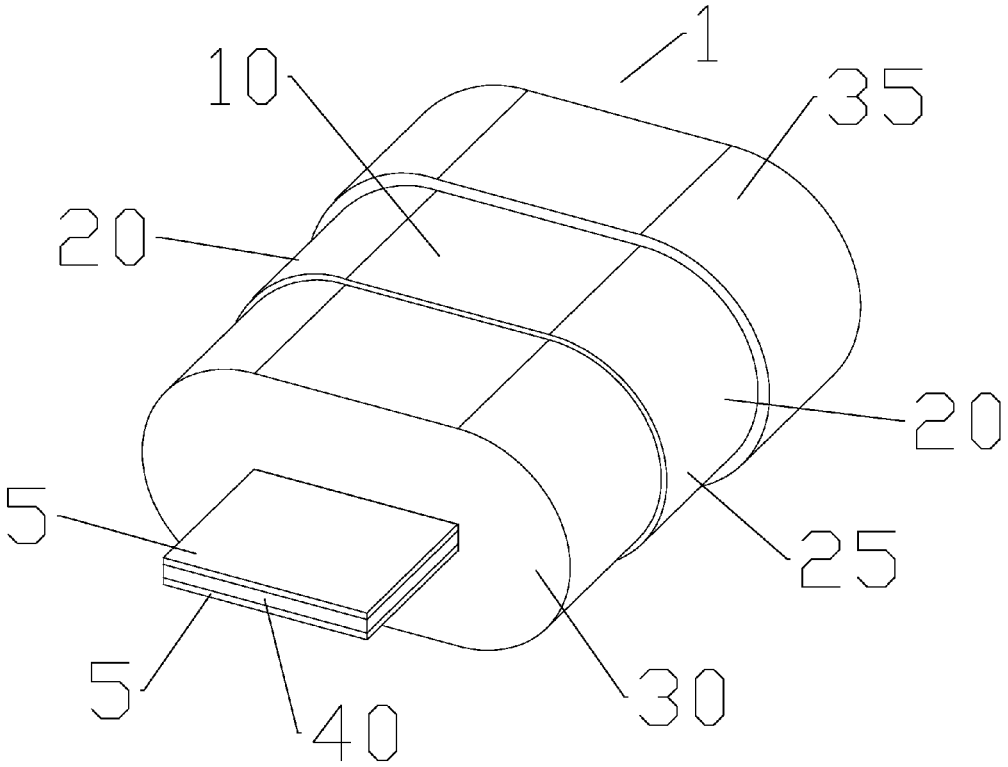
FIG. 4 is a schematic isometric view of an alternative transmission line, with layers of the conductors, dielectric spacer and outer jacket stripped back.

Alternatively, the inner conductor 5 may be provided as a substrate 40 such as a polymer and/or fiber strip that is metal coated or metalized, for example as shown in FIG. 4. One skilled in the art will appreciate that such alternative inner conductor configurations may enable further metal material reductions and/or an enhanced strength characteristic enabling a corresponding reduction of the outer conductor strength characteristics.

The dielectric layer 30 may be applied as a continuous wall of plastic dielectric material around the outer surface of the inner conductor 5. The dielectric layer 30 may be a low loss dielectric formed of a suitable plastic such as polyethylene, polypropylene, and/or polystyrene. The dielectric material may be of an expanded cellular foam composition, and in particular, a closed cell foam composition for resistance to moisture transmission. Any cells of the cellular foam composition may be uniform in size. One suitable foam dielectric material is an expanded high density polyethylene polymer as disclosed in commonly owned U.S. Pat. No. 4,104,481, titled "Coaxial Cable with Improved Properties and Process of Making Same" by Wilkenloh et al, issued Aug. 1, 1978, hereby incorporated by reference in the entirety. Additionally, expanded blends of high and low density polyethylene may be applied as the foam dielectric.

Although the dielectric layer 30 generally consists of a uniform layer of foam material, as described in greater detail herein below, the dielectric layer 30 can have a gradient or graduated density varied across the dielectric layer 30 cross section such that the density of the dielectric increases and/or decreases radially from the inner conductor 5 to the outer diameter of the dielectric layer 30, either in a continuous or a step-wise fashion. Alternatively, the dielectric layer 30 may be applied in a sandwich configuration as two or more separate layers together forming the entirety of the dielectric layer 30 surrounding the inner conductor 5.

The dielectric layer 30 may be bonded to the inner conductor 5 by a thin layer of adhesive. Additionally, a thin solid polymer layer and another thin adhesive layer may be present, protecting the outer surface of the inner conductor 5 for example as it is collected on reels during cable manufacture processing.

The outer conductor 25 is electrically continuous, entirely surrounding the circumference of the dielectric layer 30 to eliminate radiation and/or entry of interfering electrical signals. The outer conductor 25 may be a solid material such as aluminum or copper material sealed around the dielectric layer as a contiguous portion by seam welding or the like. Alternatively, helical wrapped and/or overlapping folded configurations utilizing, for example, metal foil and/or braided type outer conductor 25 may also be utilized.

If desired, a protective jacket 35 of polymer materials such as polyethylene, polyvinyl chloride, polyurethane and/or rubbers may be applied to the outer diameter of the outer conductor. The jacket 35 may comprise laminated multiple jacket layers to improve toughness, strippability, burn resistance, the reduction of smoke generation, ultraviolet and weatherability resistance, protection against rodent gnaw through, strength resistance, chemical resistance and/or cut-through resistance.

The flattened characteristic of the cable 1 has inherent bend radius advantages. As best shown in FIG. 3, the bend radius of the cable perpendicular to the horizontal plane of the inner conductor 5 is reduced compared to a conventional coaxial cable of equivalent materials dimensioned for the same characteristic impedance. Since the cable thickness between the top section 10 and the bottom section 15 is thinner than the diameter of a comparable coaxial cable, distortion or buckling of the outer conductor 25 is less likely at a given bend radius. A tighter bend radius also improves warehousing and transport aspects of the cable 1, as the cable 1 may be packaged more efficiently, for example provided coiled upon smaller diameter spool cores which require less overall space.

Electrical modeling of stripline-type RF cable structures with top and bottom sections with a width similar to that of the inner conductor (as shown in FIGS. 1-4) demonstrates that the electric field generated by transmission of an RF signal along the cable 1 and the corresponding current density with respect to a cross section of the cable 1 is greater along the inner conductor edges 3 at either side of the inner conductor 5 than at a mid-section 7 of the inner conductor. Uneven current density generates higher resistivity and increased signal loss. Therefore, the cable configuration may have an increased attenuation characteristic, compared to conventional circular/coaxial type RF cable structures where the inner conductor circumferences are equal.

To obtain the materials and structural benefits of the stripline RF transmission cable 1 as described herein, with a reduced attenuation characteristic, the electric field strength and corresponding current density may be balanced by increasing the current density proximate the mid-section 7 of the inner conductor 5. The current density may be balanced, for example by modifying the dielectric constant of the dielectric layer 30 to provide an average dielectric constant that is lower between the inner conductor edges 3 and the respective adjacent edge sections 20 than between a mid-section 7 of the inner conductor 5 and the top and the bottom sections 10,15. Thereby, the resulting current density may be adjusted to be more evenly distributed across the cable cross section to reduce attenuation.

The dielectric layer 30 may be formed with layers of, for example expanded open and/or closed cell foam, dielectric material where the different layers of the dielectric material have a varied dielectric constant. The differential between dielectric constants and the amount of space within the dielectric layer 30 allocated to each type of material may be utilized to obtain the desired average dielectric constant of the dielectric layer 30 in each region of the cross section of the cable 1.

Figure 5:
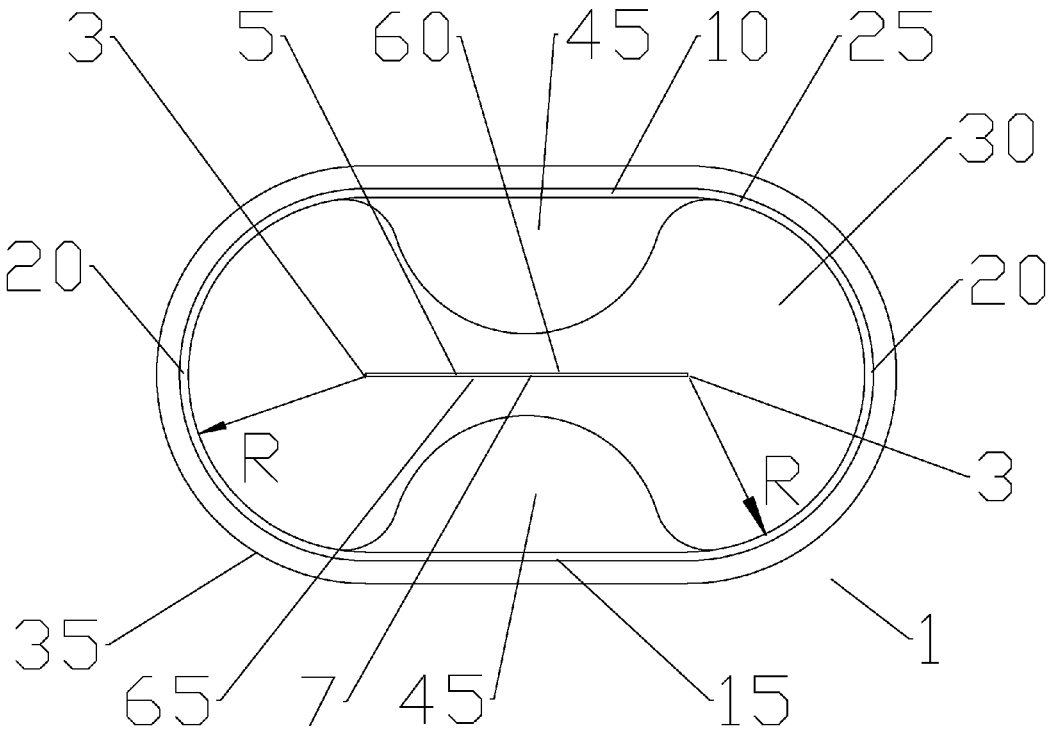
FIG. 5 is a schematic end view of an alternative embodiment transmission line utilizing varied dielectric layer dielectric constant distribution.
Figure 6:
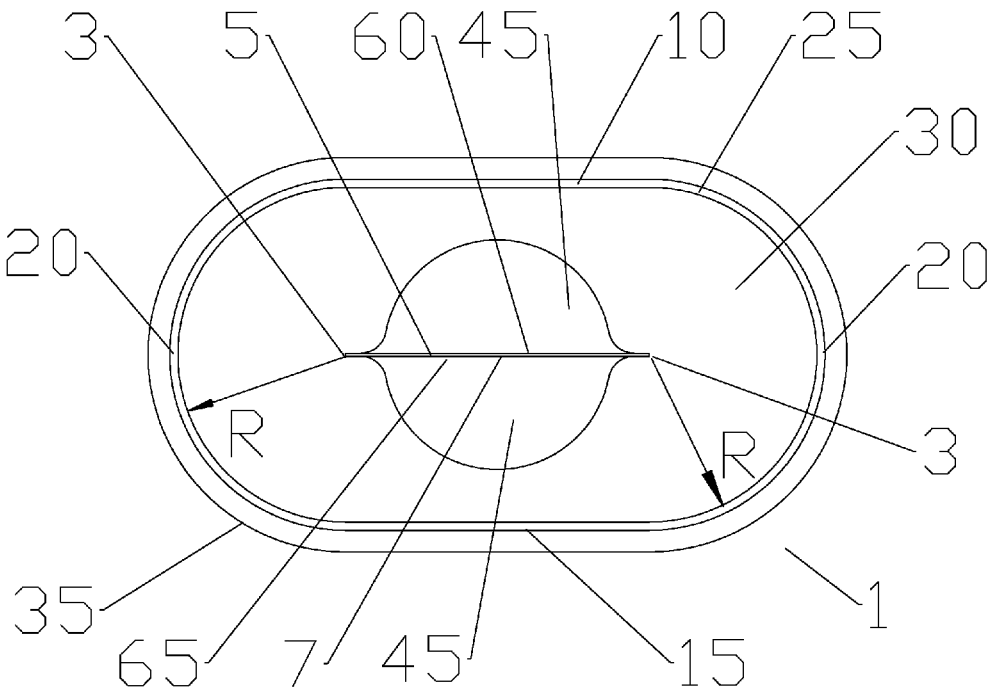
FIG. 6 is a schematic end view of another alternative embodiment transmission line utilizing varied dielectric layer dielectric constant distribution.

As shown for example in FIG. 5, a dome shaped increased dielectric constant portion 45 of the dielectric layer 30 may be applied proximate the top section 10 and the bottom section 15 extending inward toward the mid-section 7 of the inner conductor 5. Alternatively, the dome shaped increased dielectric constant portion 45 of the dielectric layer 30 proximate the inner conductor 5 may be positioned extending outward from the mid-section 7 of the inner conductor 5 towards the top and bottom sections 10,15, as shown for example in FIG. 6.

Figure 7:
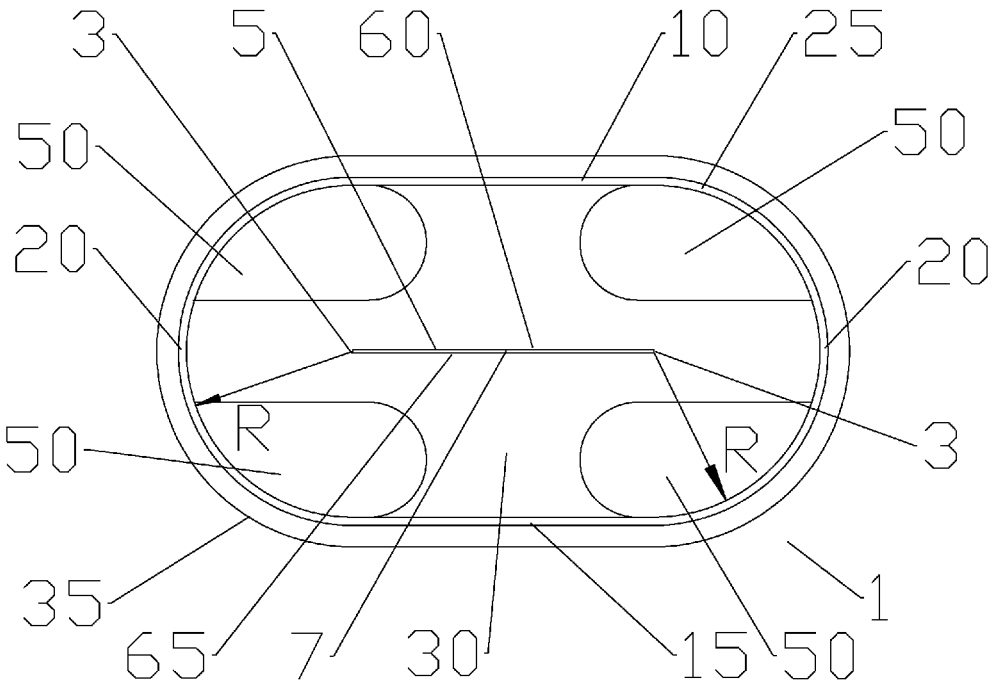
FIG. 7 is a schematic end view of an alternative embodiment transmission line utilizing cavities for varied dielectric layer dielectric constant distribution.

Air may be utilized as a low cost dielectric material. As shown for example in FIG. 7, one or more areas of the dielectric layer 30 proximate the edge sections 20 may be applied as a cavity 50 extending along a longitudinal axis of the cable 1. Such cavities 50 may be modeled as air (pressurized or unpressurized) with a dielectric constant of approximately 1 and the remainder of the adjacent dielectric material of the dielectric layer 30 again selected and spaced accordingly to provide the desired dielectric constant distribution across the cross section of the dielectric layer 30 when averaged with the cavity portions allocated to air dielectric.

Figure 8:
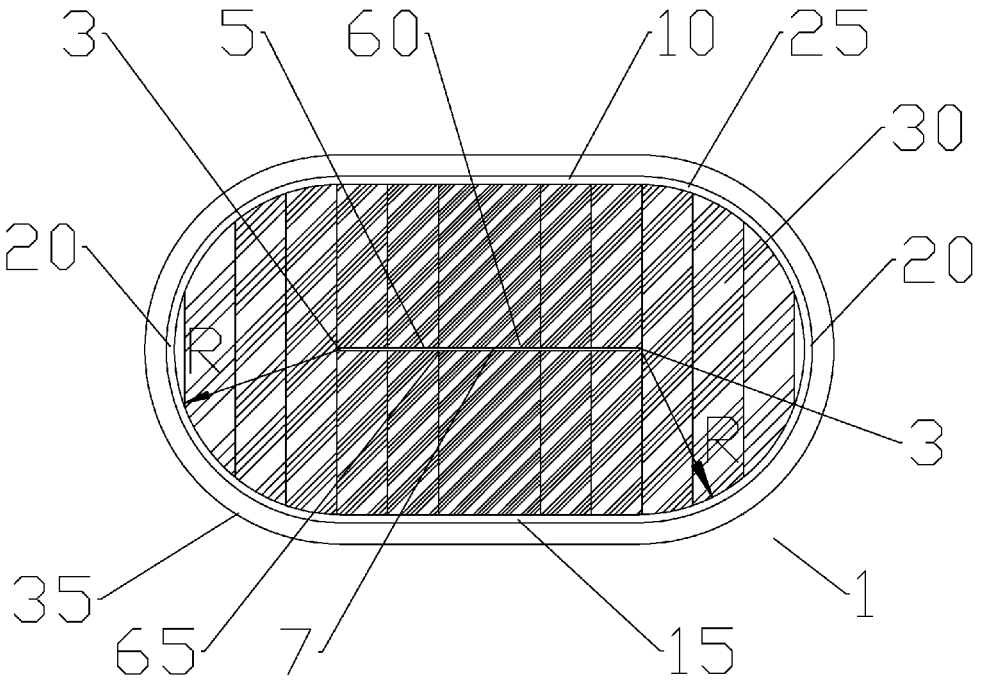
FIG. 8 is a schematic end view of an alternative embodiment transmission line utilizing sequential vertical layers of varied dielectric constant in the dielectric layer.
Figure 9:
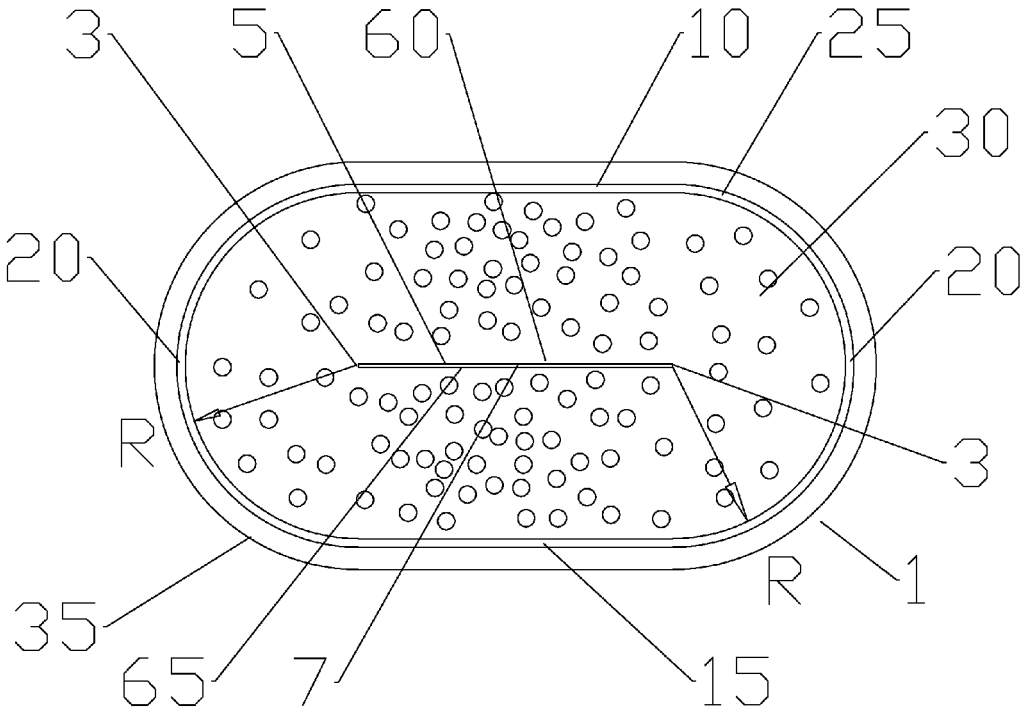
FIG. 9 is a schematic end view of an alternative embodiment transmission line utilizing dielectric rods for varied dielectric layer dielectric constant distribution.

As shown for example in FIG. 8, multiple layers of dielectric material may be applied, for example as a plurality of vertical layers aligned normal to the horizontal plane of the inner conductor 5, a dielectric constant of each of the vertical layers provided so that the resulting overall dielectric layer dielectric constant increases towards the mid-section 7 of the inner conductor 5 to provide the desired aggregate dielectric constant distribution across the cross section of the dielectric layer 30. Alternatively, for example as shown in FIG. 9, the dielectric material may be applied, for example as simultaneous high and low (relative to one another) dielectric constant dielectric material streams through multiple nozzles with the proportions controlled with respect to cross section position by the nozzle distribution or the like so that a position varied mixed stream of dielectric material is applied to obtain a desired, for example generally smooth, gradient of the dielectric constant across the cable cross section, so that the resulting overall dielectric constant of the dielectric layer 30 increases in a generally smooth gradient from the edge sections 20 towards the mid-section 7 of the inner conductor 5.

Figure 10:
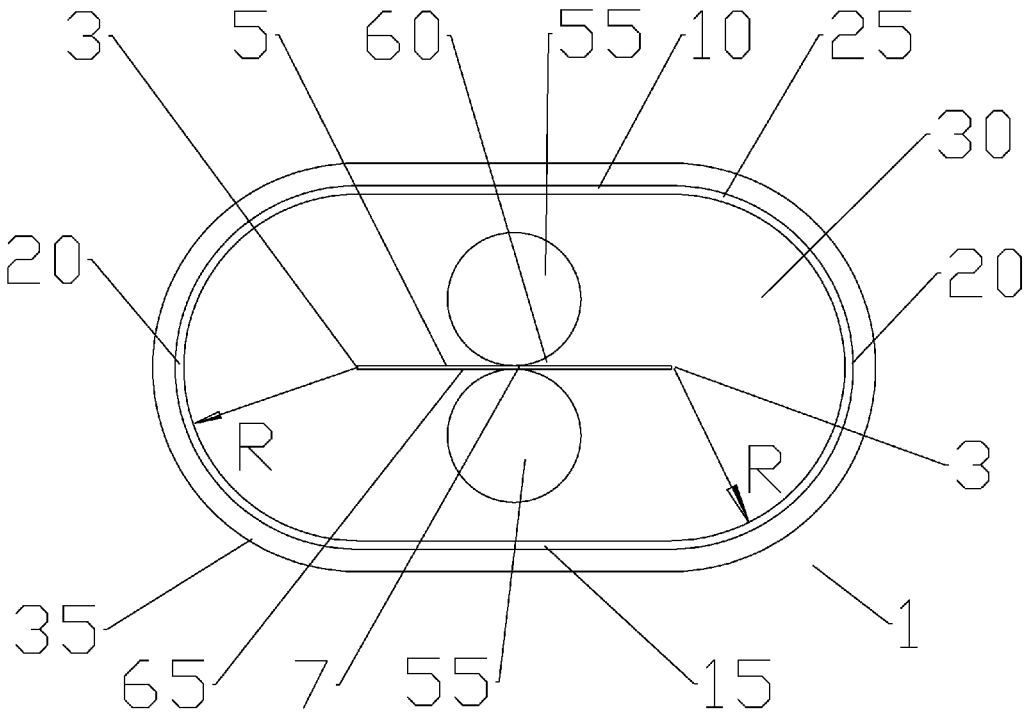
FIG. 10 is a schematic end view of an alternative embodiment transmission line utilizing dielectric rods for varied dielectric layer dielectric constant distribution.

The materials selected for the dielectric layer 30, in addition to providing varying dielectric constants for tuning the dielectric layer cross section dielectric profile for attenuation reduction, may also be selected to enhance structural characteristics of the resulting cable 1. For example as shown in FIG. 10, the dielectric layer 30 may be provided with first and second dielectric rods 55 located proximate a top side 60 and a bottom side 65 of the mid-section 7 of the inner conductor 5. The dielectric rods 55, in addition to having a dielectric constant greater than the surrounding dielectric material, may be for example fiberglass or other high strength dielectric materials that improve the strength characteristics of the resulting cable 1. Thereby, the thickness of the inner conductor 5 and/or outer conductor 25 may be reduced to obtain overall materials cost reductions without compromising strength characteristics of the resulting cable 1.

Figure 11:
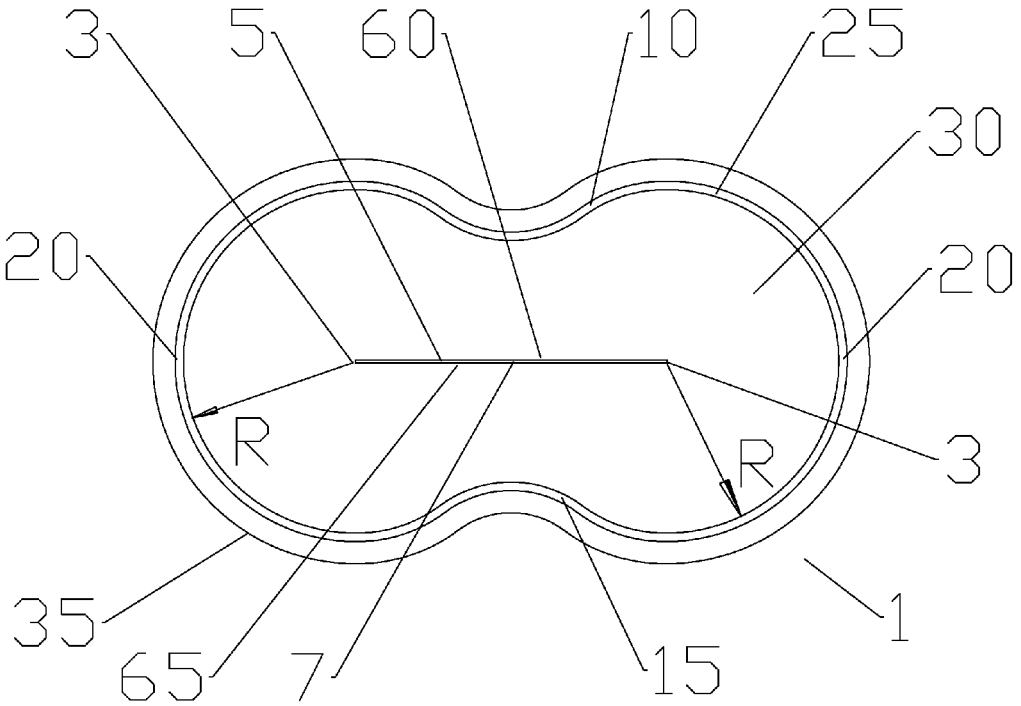
FIG. 11 is a schematic end view of an alternative embodiment transmission line utilizing varied outer conductor spacing to modify operating current distribution within the transmission line.

Alternatively and/or additionally, the electric field strength and corresponding current density may also be balanced by adjusting the distance between the outer conductor 25 and the mid-section 7 of the inner conductor 5. For example as shown in FIG. 11, the outer conductor 25 may be provided spaced farther away from each inner conductor edge 3 than from the mid-section 7 of the inner conductor 5, creating a generally hour glass shaped cross section. The distance between the outer conductor 25 and the mid-section 7 of the inner conductor 5 may be less than, for example, 0.7 of a distance between the inner conductor edges 3 and the outer conductor 25 (at the edge sections 20).

Figure 12:
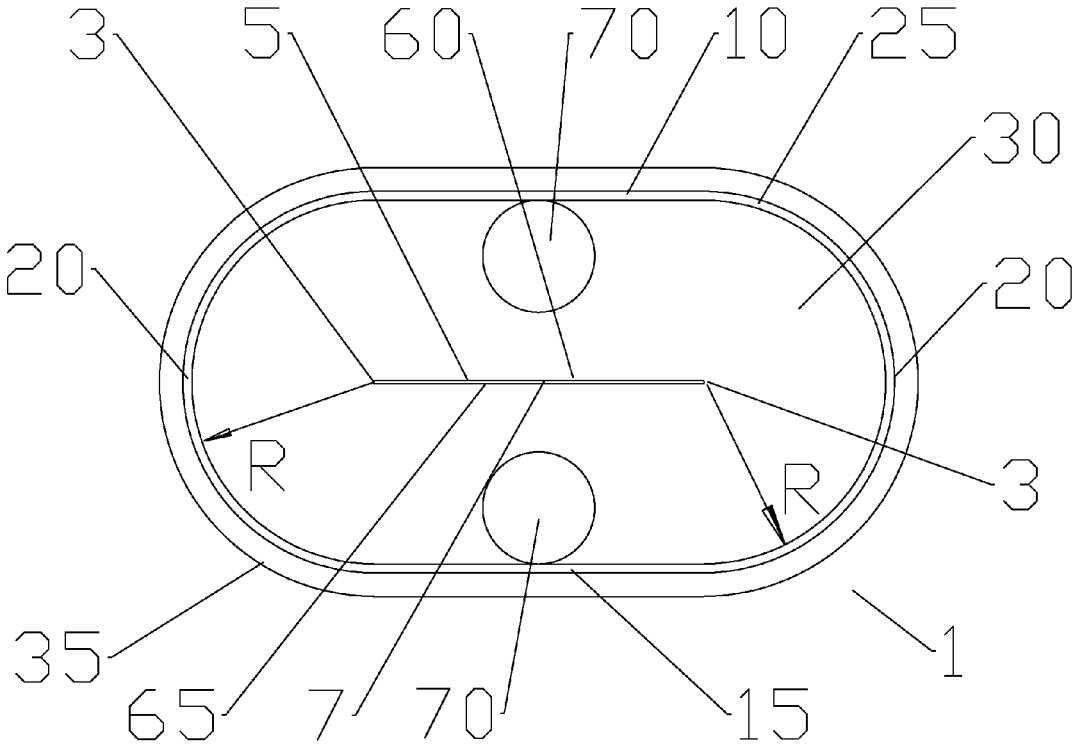
FIG. 12 is a schematic end view of another alternative embodiment transmission line utilizing drain wires for varied outer conductor spacing to modify operating current distribution within the transmission line.

The dimensions may also be modified, for example as shown in FIG. 12, by applying a drainwire 70 coupled to the inner diameter of the outer conductor 25, one proximate either side of the mid-section 7 of the inner conductor 5. Because each of the drain wires 70 is electrically coupled to the adjacent inner diameter of the outer conductor 25, each drain wire 70 becomes an inward projecting extension of the inner diameter of the outer conductor 25, again forming the generally hour glass cross section to average the resulting current density for attenuation reduction. As described with respect to the dielectric rods 55 of FIG. 10, the drain wires 70 may similarly increase structural characteristics of the resulting cable, enabling cost saving reduction of the metal thicknesses applied to the inner conductor 5 and/or outer conductor 25.

One skilled in the art will appreciate that the cable 1 has numerous advantages over a conventional circular cross section coaxial cable. Because the desired inner conductor surface area is obtained without applying a solid or hollow tubular inner conductor, a metal material reduction of one half or more may be obtained. Alternatively, because complex inner conductor structures which attempt to substitute the solid cylindrical inner conductor with a metal coated inner conductor structure are eliminated, required manufacturing process steps may be reduced. Further, the flat inner conductor 5 configuration is particularly well suited for cable termination upon/interconnection with planar termination surfaces such as printed circuit boards and the like.

Table of Parts

| | |
|---|---|
| 1 | cable |
| 3 | inner conductor edge |
| 5 | inner conductor |
| 7 | mid-section |
| 10 | top section |
| 15 | bottom section |
| 20 | edge section |
| 25 | outer conductor |
| 30 | dielectric layer |
| 35 | jacket |
| 40 | substrate |
| 45 | increased dielectric constant portion |
| 50 | cavity |
| 55 | dielectric rod |
| 60 | top side |
| 65 | bottom side |
| 70 | drain wire |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A stripline RF transmission cable, comprising:

a flat inner conductor extending between a pair of inner conductor edges;

the inner conductor surrounded by a dielectric layer, wherein the dielectric layer is a continuous layer between the inner conductor and the outer conductor; and an outer conductor provided with a top section and a bottom section;

the top section and bottom section spaced farther away from each inner conductor edge than from a midsection of the inner conductor;

wherein the outer conductor has a generally hour glass shaped cross section.

2. The cable of claim 1, wherein a distance between the outer conductor and the midsection of the inner conductor is less than a distance between the inner conductor edges and the outer conductor.

3. The cable of claim 1, wherein a distance between the outer conductor and the mid section of the inner conductor is 0.7 of a distance between the inner conductor edges and the outer conductor.

4. The cable of claim 1, wherein the dielectric layer fills a space between the inner conductor and the outer conductor.

5. The cable of claim 1, wherein the flat inner conductor is a flat metallic strip.

* * * * *